United States Patent [19]

Kido et al.

[11] Patent Number: 4,928,540

[45] Date of Patent: May 29, 1990

[54] METHOD OF DISPENSING COAGULATIVE TEST LIQUID

[75] Inventors: Keishiro Kido; Sigeru Tezuka, both of Saitama, Japan

[73] Assignee: Fuji Photo Film, Co., Ltd., Kanagawa, Japan

[21] Appl. No.: 299,272

[22] Filed: Jan. 18, 1989

[30] Foreign Application Priority Data

Jan. 18, 1988 [JP] Japan ..... 63-7858

[51] Int. Cl.[5] ..... B01L 3/02

[52] U.S. Cl. ..... 73/864.11; 436/46; 422/63

[58] Field of Search ..... 73/864.81, 864.11; 422/65, 68, 73, 100, 63; 141/31, 83, 116–119, 130; 222/1; 436/46, 54, 162, 179, 180

[56] References Cited

U.S. PATENT DOCUMENTS 3,913,801 10/1975 Wise et al. ..... 141/116

4,452,899 6/1984 Alston ..... 141/119

4,800,762 1/1989 Sugaya ..... 73/864.24

OTHER PUBLICATIONS

Taylor, "Protective Coating Applicator", IBM Technical Disclosure Bulletin, vol. 8, No. 1, Jun. 1965.

*Primary Examiner*—Robert R. Raevis

*Attorney, Agent, or Firm*—Sughrue, Mion, Zinn, Macpeak & Seas

[57] ABSTRACT

A nozzle of a dispenser is filled with a coagulative liquid specimen. Then, the liquid is drawn into the dispenser such that a lower surface of the liquid is spaced from the lower end of the nozzle by a distance which is not smaller than the inner diameter of the nozzle. The liquid is maintained at this position before the next discharging operation is carried out to discharge a predetermined amount of coagulated test liquid onto a chemical assay slide for incubation of the test liquid.

5 Claims, 2 Drawing Sheets

METHOD OF DISPENSING COAGULATIVE TEST LIQUID

BACKGROUND OF THE INVENTION

1. Field of the Invention

This invention relates to a method for repeatedly dispensing a predetermined amount of a test liquid onto a chemical assay element such as a chemical assay slide by using a dispenser.

2. Description of the Prior Art

When the amount of a specific chemical ingredient in a specimen of a liquid such as the body fluid of an organism, e.g. blood or urine, is to be determined by using a chemical assay element, such as a chemical assay slide, it is necessary to measure out a predetermined amount of the liquid specimen precisely and supply it to the chemical assay element. For this purpose, dispensers such as those supplied by Eppendorf (e.g. No.4780) and Nichiryo (e.g. model 8100) have been used widely.

When blood, blood plasma or the like is in contact with air for about 30 seconds, it begins to coagulate. When a dispenser is used to supply repeatedly a coagulative liquid specimen like this, the liquid coagulates at the tip of the nozzle of the dispenser a short time after the test liquid is drawn in and left there. In such cases, it is difficult to dispense the liquid specimen. For example, under the temperature of 24° C. and the relative humidity of 40%, blood coagulates after it is left in the dispenser for about 40 seconds and a certain kind of commercially-available controlled serum coagulates after it is left there for about 3 minutes. Accordingly, in order to supply such a coagulative liquid to a chemical assay element, it is necessary to conduct the dispensing operation within a short time before coagulation begins.

However, the dispensing operation for a single test liquid may take more than several minutes. The dispenser is often used in combination with an automatic analyzer. In such cases, it is not always possible to dispense the test liquid continuously.

An Automatic analyzer often has an incubator in order to allow a chemical reaction necessary for assay to take place. A plurality of assay elements like assay slides, assay tapes or assay cells can be passed through the incubator continuously if the time required for each assay element to pass therethrough is constant. Therefore, in general, the dispensing operation of the liquid specimen can be conducted continuously in these situations. However, if the time required for each assay element to pass through the incubator differs according to the assay items (ingredients to be tested for), the dispensing of the liquid specimen may not always be conducted continuously.

The automatic analyzer disclosed in Japanese Unexamined Patent Publication No. 61(1986)-294368 (Sugaya) has a plurality of incubation chambers each of which is adapted to contain a chemical assay slide. Therefore, in this analyzer, each slide can be maintained at a constant temperature for a desired period. In order to conduct analysis operations efficiently, i.e. to conduct as many analysis operations as possible within a predetermined time, by using such an automatic analyzer, it is desirable that the incubation chambers be kept filled with the slides. If there is a vacant incubation chamber sometime after a certain portion of the liquid has been dispensed and the chamber has been filled with the slides, the next portion of the liquid is dispensed to an assay slide which will be inserted into the vacant incubation chamber. After still another chamber is vacated, the remaining portion of the liquid specimen will be dispensed to a chemical slide.

In such cases, the test liquid is held within the dispenser from the first dispensing (discharging) operation to the next dispensing (discharging) operation. If the liquid coagulates during this period, it will be difficult to dispense the liquid . That is, if the liquid coagulates, no liquid may be discharged from the nozzle or an excessive amount of the liquid may happen to be discharged abruptly therefrom, because the piston, the pump or the like continues to operate in spite of the interruption of the discharge.

Even when there are vacant incubator chambers, the liquid has to be held within the dispenser for a period of time until a dispensing (discharging) operation takes place, if the assay slides or the like are not prepared in good time due to certain accidents. If the liquid specimen coagulates in these cases, dispensing of the liquid will be difficult.

SUMMARY OF THE INVENTION

The object of the present invention is to provide a process for supplying repeatedly a predetermined amount of a coagulative liquid specimen to an assay element by using a dispenser in which the liquid specimen can be dispensed or supplied without coagulation even after the liquid specimen has been left in the dispenser, especially in a nozzle thereof, for a predetermined period of time.

The above-mentioned object is achieved by a process for dispensing repeatedly a predetermined amount of a coagulative liquid specimen by using a dispenser, in which the liquid specimen in a nozzle of the dispenser is drawn further into the dispensers such that the lower face of the liquid specimen is retracted from the lower end of the nozzle by a distance which is not smaller than an inner diameter of the nozzle, and the liquid specimen is maintained at this position for a predetermined period of time before the next dispensing operation of the liquid.

The above-mentioned object is effectively achieved in particular, by a process in which, on the one hand, if the liquid specimen is to be discharged from the nozzle of the dispenser within a predetermined period of time, the liquid is filled in the nozzle and held there before the earliest or next discharging, and on the other hand, if the time before the earliest or next discharging is likely to exceed the predetermined period, the liquid is drawn further into the nozzle such that the lower surface of the liquid is retracted from the lower end of the nozzle by a distance not smaller than the inner diameter of the nozzle and held there until the next discharging.

In the process of the present invention, in general, a pipette which can discharge a predetermined amount of a liquid repeatedly is used as a liquid metering container. The method of the present invention is particularly useful for supplying repeatedly a liquid in amounts on the order of 1 μl to 10 μl. The pipette disclosed, for example, in U.S. Pat. Nos. 3,494,201, 3,732,734, 3,732,735, 3,757,586, 3,766,784, 3,766,785, or 4,023,716, may be used in the method of the present invention. The pipette usually has a cylinder and a piston. The pipette may be equipped with a fixed nozzle or a detachable and disposable nozzle tip. As the nozzle tip, one such as disclosed in U.S. Pat. Nos. 4,072,330, 4,237,095 or 4,347,875, for example, may be used. The surface of the nozzle may be coated with fluorocarbon polymer as described in U.S. Pat. No. 3,500,689. Commercially-available nozzle tips are usually made of polypropylene so that they can be processed accurately in manufacture.

The inner diameter of the end tip of the nozzle of the pipette or the like used in the present invention is of the order of 0.2 mm to 1 mm, and preferably in the range of 0.3 mm to 0.8 mm.

In the process of the present invention, the first discharging operation is conducted within a predetermined interval of time, e.g. 30 seconds, after the liquid specimen is drawn into the nozzle. When the liquid is to be discharged repeatedly within the predetermined interval of time, the liquid is held so that it fills the tip end tip of the nozzle. If the next discharging operation may be conducted after the certain interval of time, the liquid is drawn further into the dispenser such that the lower surface of the liquid is retracted from the tip end of the nozzle by a distance not smaller than the inner diameter of the nozzle and maintained there until the next discharging operation. For example, the lower surface of the test liquid is drawn back away from the nozzle tip by 0.2 mm to 1 mm or more, according to the inner diameter of the nozzle.

As for disposable tips, the length of the nozzle is automatically determined by the amount of the liquid to be contained therein.

Using the process in accordance with the present invention, the liquid does not coagulate in the dispenser even when the liquid stays therein for a while before being discharged. Thus, the liquid can be dispensed without trouble.

DESCRIPTION OF THE PREFERRED EMBODIMENTS

Figure 1:
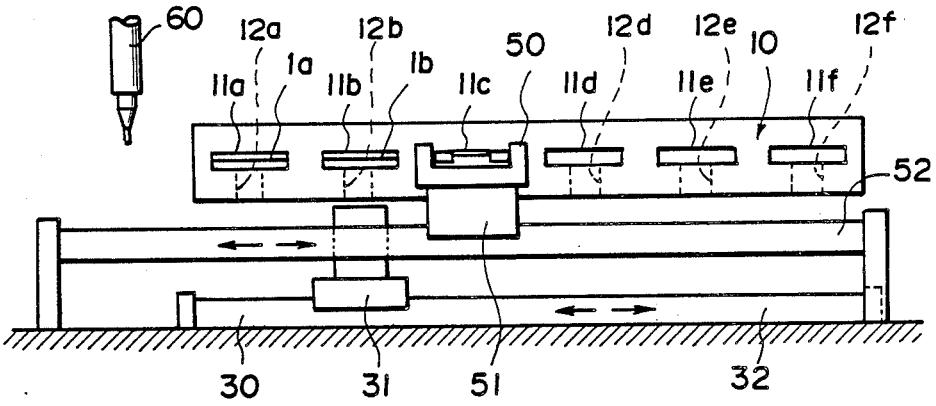
FIG. 1 is a front elevation of an automatic analyzer used in an embodiment of the present invention.
Figure 2:
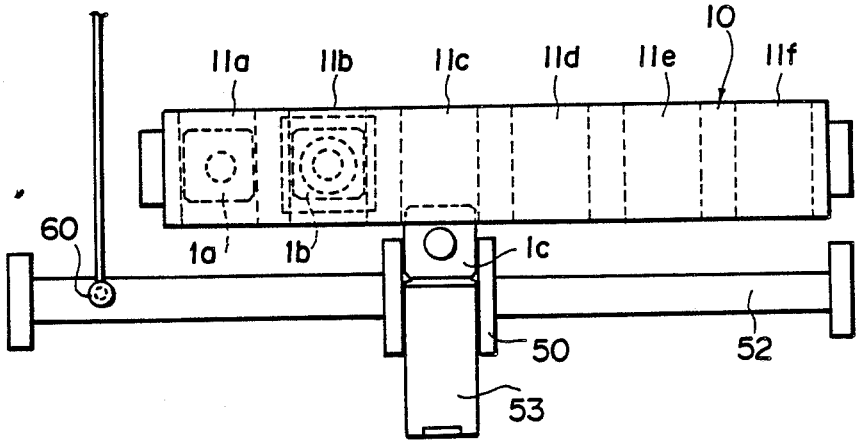
FIG. 2 is a plan view thereof with an initial chemical assay slide being inserted in the third incubator chamber from the left.

An automatic analyzer is produced as described in Japanese Unexamined Patent Publication No. 61(1986)-294368. A front elevation of this analyzer is shown in FIG. 1. An incubator 10 maintained at a constant temperature by means of a heater (not shown) has incubator chambers 11*a*, 11*b*, 11*c*, 11*d*, 11i e and 11*f*. Chemical assay slides 1*a*, 1*b*, lc, 1*d*, 1*e*, and 1*f* are respectively received in these chambers. A probe 30 for optical measurements is disposed below the incubator 10. The probe 30 is movable along the row of incubator chambers 11*a*–11*f*, i.e. the row of chemical assay slides 1*a*–l*f*. Below the incubator chambers 11*a*–11*f*, openings 12*a*–12*f* are respectively provided. Through each opening, a change in color (or fluorescence or the like) of the reagent layer in each chemical assay slide can be measured in terms of the optical density of the light reflected therefrom or the like.

The chemical assay slides are sequentially mounted on a slide conveying means 50. The slide conveying means 50 is moved along the row of incubator chambers 11*a*–11*f* by means of a linear motor which has a stator 52. The chemical assay slides 1*a*–l*f* are respectively inserted into the incubator chambers 11*a*–11*f* by means of a push lever 53. After the required chemical reaction and measurement thereof have been completed, the chemical assay slides are discharged from the end of the incubator chambers 11*a*–11*f*, remote from the lever 53, by inserting the lever 53 further into these chambers preferably with a second chemical assay slide interposed between the initial chemical assay slide and the end of lever 53 to simultaneously replace the initial slide with the second slide.

A dispenser pipette (of the same type as one described in Japanese Patent Application No. 61(1986)-144258), which has a whole capacity of 110 μl and a nozzle tip with a inner diameter of 0.5 mm, is disposed such that a liquid spotting aperture on the chemical assay slide is placed directly below the tip of the nozzle when the slide conveying means 50 is placed to the left end of the stator 52.

The chemical assay slides from 1*a* to 1*h* are prepared for assay of the following items.

| ITEM | CHEMICAL ASSAY SLIDE | |
|---|---|---|
| glucose | 1a | 1e |
| bilirubin | 1b | 1f |
| cholesterol | 1c | 1g |
| urea and nitrogen | 1d | 1h |

100 μ of a first whole blood sample is drawn into the nozzle tip of the above-mentioned pipette. Immediately thereafter, the chemical assay slide 1*a* is mounted on the slide conveying means 50 which is positioned at the left end of the stator 52, and 10 μ of the first whole blood sample is spotted on the chemical assay slide 1*a*. After this spotting, the rest of the first whole blood sample is left in the tip of the nozzle tip. The slide conveying means 50 is moved toward the incubator chamber 11*a*. The chemical assay slide 1*a* is inserted into this incubator chamber 11*a* by using the lever 53. Then, the slide conveying means 50 is returned to the left end of the stator 52. In the same manner as the chemical assay slide 1*a*, the chemical assay slide 1*b* is mounted on the slide conveying means 50, the first whole blood sample is spotted on the chemical assay slide 1*b*, and then the chemical assay slide 1*b* is inserted into the incubator chamber 11*b*. Similarly, the first whole blood sample is spotted on the chemical assay slides 1*c* and 1*d* and inserted into the incubator chambers 11*c* and 11*d*, respectively. The spotting operations are conducted in 10-second intervals.

A second whole blood sample is drawn into the dispenser pipette after replacing the nozzle tip for a new one Then, 10 μ each of the whole blood sample is spotted on the chemical assay slides 1*e* and 1*f*. (The chemical slides 1*a* and 1*e* are of one type, while the chemical slides 1*b* and 1*f* are of another type.) The chemical slides 1*e* and 1*f* are inserted into the incubator chambers 11*e* and 11*f*, respectively. Within 3 seconds after spotting on the chemical assay slide 1*f*, the second whole blood sample is drawn back into the dispensers such that the lower end of the sample is retracted from the lower end of the nozzle tip by 1 mm. The chemical assay slide 1*e* is inserted into the incubator chamber 11*e* about 20 seconds after the chemical assay slide 1*d* was inserted into the incubator chamber 11*d*.

After the chemical assay slides 1*a*–1*f* have been incubated in their respective incubator chambers 11*a*–11*f* for 6 minutes, the optical density of the light reflected from the reagent layer of each chemical assay slide is determined through the openings 12*a*–12*f* by the probe 30. Measurements of the samples are conducted in 10-second intervals. A total time of 73 seconds is required for the measurements of the first and second blood samples. After the measurements, the chemical assay slides are discharged from the corresponding incubator chambers.

Figure 3:
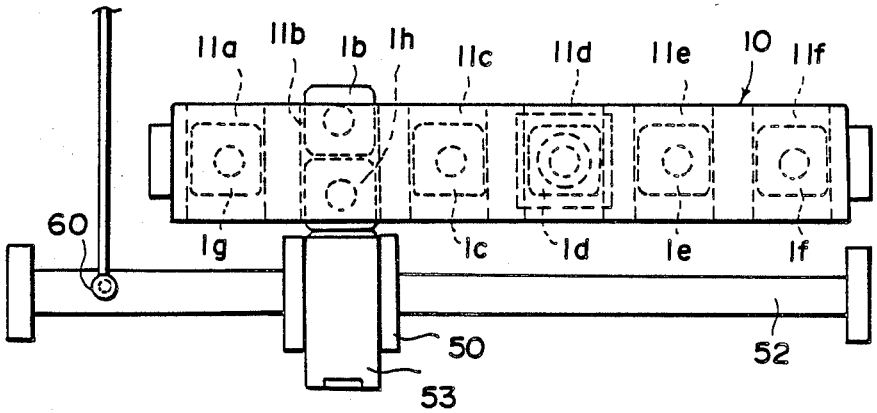
FIG. 3 is a plan view similar to that of FIG. 2 with a second chemical assay slide being inserted into the second incubator chamber from the left, while pushing an initial chemical assay slide therefrom to the opposite side of its insertion.

Before the chemical assay slides. 1*a* and 1*b* are discharged from the incubator chambers 11*a* and 11*b*, the remaining portion of the second whole blood sample is held within the nozzle tip of the dispenser pipette for about 7 minutes. Thereafter, the second whole blood sample is spotted on the chemical assay slide 1*g* mounted on the slide conveying means 50 which is placed at the left ultimate of the stator 52. The chemical assay slide 1*g* is then inserted into the incubator chamber 11*a*. Similarly, the second whole blood sample is spotted on the chemical assay slide 1*h*, which is inserted into the incubator chamber 11*b* immediately thereafter, FIG. 3. The interval between the spotting operations for the chemical assay slides 1*g* and 1*h* is 10 seconds. The optical density of the light reflected from the reagent layer of each chemical assay slide is measured 6 minutes after each chemical assay slide has been inserted into the corresponding incubator chamber. After the measurements are made, each chemical assay slide is discharged from the corresponding incubator chamber.

The second whole blood sample does not coagulate even after being held within the nozzle tip for about 7 minutes since the sample is drawn into the dispenser such that the lower end thereof is retracted from the lower end of the nozzle tip by 1 mm. Therefore, the second whole blood sample can be spotted again without any trouble.

On the contrary, when the whole blood sample is held within the nozzle tip for 7 minutes such that the nozzle tip is filled to its lower end with the sample, it coagulates therewithin and cannot be discharged therefrom.

We claim:

1. A process of repeatedly supplying a predetermined amount of a coagulative test liquid onto a chemical assay slide for incubation of the test liquid, said process comprising the steps of;

filling a nozzle of a dispenser with said test liquid, drawing said test liquid back into said dispenser such that a lower surface of said test liquid is retracted from a lower tip end of said nozzle by a distance which is not smaller than an inner diameter of said nozzle, holding said test liquid for a period of time of 3 minutes or more retracted from the lower tip end of the nozzle by said distance to prevent coagulation of said test liquid, and then discharging a predetermined amount of said test liquid.

2. A process as defined in claim 1 in which said test liquid is selected from a group consisting of whole blood, diluted whole blood, plasma and diluted plasma.

3. A process of repeatedly supplying a predetermined amount of a coagulative test liquid onto a chemical assay slide for incubation of the test liquid, said process comprising the steps of;

filling a nozzle of a dispenser with said test liquid, holding said test liquid in a lower end of the nozzle if said test liquid is to be discharged therefrom within a predetermined span of time, drawing said test liquid back into said dispenser such that a lower surface of said test liquid is spaced from a lower tip end of said nozzle by a distance which is not smaller than an inner diameter of said nozzle if said test liquid is not to be discharged therefrom within said predetermined span of time to prevent coagulation thereof prior to discharge, and then discharging a predetermined amount of said test liquid.

4. A process as defined in claim 3 in which said predetermined span of time is 30 seconds.

5. A process as defined in claim 3 in which said test liquid drawn into said dispenser is spaced from the lower tip end of said nozzle by said distance for a period of not less than 3 minutes.

* * * * *